US008282423B2

(12) United States Patent
Nakazawa et al.

(10) Patent No.: US 8,282,423 B2
(45) Date of Patent: Oct. 9, 2012

(54) CONNECTOR INCLUDING ALIGNMENT MEMBER THAT PREVENTS RELATIVE MOVEMENT OF ONE ROW OF COMBINATION GROUND CONTACTS TOWARD ANOTHER ROW OF COMBINATION GROUND CONTACTS

(75) Inventors: Katsuhiko Nakazawa, Tokyo (JP); Yasukazu Itou, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 56 days.

(21) Appl. No.: 12/938,471

(22) Filed: Nov. 3, 2010

(65) Prior Publication Data

US 2011/0111641 A1 May 12, 2011

(30) Foreign Application Priority Data

Nov. 6, 2009 (JP) ..... 2009-255141

(51) Int. Cl.
*H01R 24/00* (2011.01)

(52) U.S. Cl. ..... 439/660; 439/79

(58) Field of Classification Search ..... 439/79, 439/108, 540.1, 541.5, 660, 701
See application file for complete search history.

(56) References Cited

U.S. PATENT DOCUMENTS 5,692,912 A * 12/1997 Nelson et al. ..... 439/79
7,828,560 B2 * 11/2010 Wu et al. ..... 439/79
7,857,665 B2 * 12/2010 Xiong et al. ..... 439/660
7,862,346 B1 * 1/2011 Wan et al. ..... 439/79

FOREIGN PATENT DOCUMENTS

JP 2001-6771 A 1/2001

* cited by examiner

*Primary Examiner* — Thanh Tam Le
(74) *Attorney, Agent, or Firm* — Holtz, Holtz, Goodman & Chick, PC

(57) ABSTRACT

A connector whose terminal portions of contacts can be reliably inserted into through holes of a circuit board. The connector comprises a housing, contacts, and an alignment member. Each contact includes a holding portion held by the housing, a terminal portion inserted into a circuit board, and a linking portion connecting the holding and terminal portions. The alignment member is mounted on the contacts and positions the terminal portions. The contacts are arranged in a longitudinal direction of the connector, and in two rows in a vertical direction thereof. Each pair of adjacent contacts in the longitudinal direction are connected by a connecting portion, to form first and second combination contacts. The alignment member has receiving portions receiving the linking portions, open portions from which the connecting portions are exposed, and grooves preventing a relative movement of the connecting portions in the vertical direction.

7 Claims, 21 Drawing Sheets

CONNECTOR INCLUDING ALIGNMENT MEMBER THAT PREVENTS RELATIVE MOVEMENT OF ONE ROW OF COMBINATION GROUND CONTACTS TOWARD ANOTHER ROW OF COMBINATION GROUND CONTACTS

BACKGROUND OF THE INVENTION

1. Field of the Invention

This invention relates to a connector.

2. Description of Related Art

Conventionally, there has been proposed a connector comprised of a plurality of contacts, a housing, and a locator (alignment member) (see Japanese Laid-Open Patent Publication (Kokai) No. 2001-006771, Paragraph Nos. 0007 to 0012 and FIGS. 9 and 10).

Each of the contacts is formed into a substantially L shape and includes a connection portion, a press-fit portion (terminal portion), and a lead terminal portion (linking portion). The connection portion is formed into a fork shape. A longitudinal direction of the press-fit portion is substantially perpendicular to a longitudinal direction of the connection portion. The press-fit portion is press-fitted into an associated one of through holes of a printed circuit board. The lead terminal portion connects between the connection portion and the press-fit portion. A wide portion is formed in the connecting region of the press-fit portion and the lead terminal portion.

The housing has contact receiving holes formed therein at predetermined space intervals along a longitudinal direction thereof. The plurality of contact receiving holes are vertically disposed in three rows (three rows comprised of a row of a contact receiving hole group located in an upper level, a row of a contact receiving hole group located in a middle level, and a row of a contact receiving hole group located in a lower level). The connection portions of the contacts are held by the housing in a state where the connection portions are received in the contact receiving holes.

The locator includes a plurality of slits and a plurality of pairs of protrusions. The lead terminal portions of the plurality of contacts held by the housing are inserted into the plurality of slits, respectively. The pairs of protrusions are each formed on an inner wall surface of each slit of the locator. The wide portion of the contact is engaged with a recesses formed in the lower surface of each protrusion. Also, the protrusion has a tapered face. The tapered face prevents the protrusion from blocking the insertion of the lead terminal portion when the lead terminal portion is inserted into the slit.

To assemble the connector, first, the connection portions of the contacts are received in the contact receiving holes of the housing, respectively, and the housing is caused to hold the contacts.

Next, the press-fit portions, the wide portions, and the lead terminal portions of the contacts are inserted into the slits of the locator, respectively. In doing so, each wide portion climbs onto the tapered face of the protrusion, and move in an array direction of the contacts against the spring force of the lead terminal portion. When the wide portion of the contact passes the protrusion, the wide portion moves downward of the protrusion by the spring force of the lead terminal portion, and engages with the recess of the lower surface of the protrusion.

By the above-described operation, the assembly of the connector is completed.

To mount the connector on the printed circuit board, leading end portions of the press-fit portions of the contacts are inserted into the through holes of the printed circuit board, respectively, and then an upper surface of the locator is pressed by using e.g. a press.

The pressing force applied to the locator by the press and the like is passed to the wide portions of the contacts via the protrusions of the locator, whereby the entire press-fit portions are press-fitted into the through holes.

In the above-described connector, when each contact is inserted into the locator, there is a fear that the protrusion is cut or shaved by the wide portion of the contact.

When the protrusion is cut, the engagement between the protrusion and the wide portion cannot be maintained, and there is a fear that it is impossible to reliably insert the press-fit portion of the contact into the associated through hole of the circuit board.

SUMMARY OF THE INVENTION

The present invention has been made in view of these circumstances, and an object thereof is to provide a connector whose terminal portions of contacts can be reliably inserted into through holes of a circuit board.

To attain the above object, the present invention provides a connector comprising a housing, a plurality of contacts each including a holding portion that is held by said housing, a terminal portion that is inserted into a circuit board, a linking portion that connects said holding portion and said terminal portion, said terminal portion extending in a direction substantially orthogonal to said linking portion, said plurality of contacts being arranged in a predetermined direction, and at the same time, disposed in two rows in a terminal portion-inserting direction that is perpendicular to the predetermined direction, said linking portions of each predetermined pair of said contacts which are adjacent to each other in the predetermined direction being connected by a connecting portion, whereby a plurality of combination contacts are formed, and an alignment member that is mounted on said plurality of contacts, for positioning said terminal portions, said alignment member including receiving portions that receive said linking portions, open portions from which said connecting portions of said combination contacts in one row of the two rows are exposed to outside, and movement preventing portions that prevent a relative movement of said connecting portions of said combination contacts in the other row of the two rows, in a direction toward the one row.

With the arrangement of the connector according to the present invention, the alignment member includes the open portions from which the connecting portions of the combination contacts in the one row are exposed to outside, and the movement preventing portions that prevent the movement of the connecting portions of combination contacts in the other row, in a direction toward the one row. Therefore, it is possible to directly press the connecting portions of combination contacts in the one row to thereby press the alignment member in a direction toward the other row. When the connecting portions of the combination contacts in the one row are pressed to press the alignment member in the direction toward the other row, even if the combination contacts in the other row attempts to relatively move toward the one row, the movement of the combination contacts in the other row is prevented by the movement preventing portions, and all of the combination contacts in the other row move along the direction toward the other row, in unison with the alignment member.

Preferably, the connector comprises a plurality of signal contacts each including a signal-side holding portion that is held by said housing, a signal-side terminal portion that is inserted into the circuit board, and a signal-side linking portion that connects said signal-side holding portion and said signal-side terminal portion, and said alignment member includes signal-side receiving portions that receive said signal-side linking portions, three sides of said signal-side linking portion of each of said signal contacts being surrounded by said linking portions of said pair of said contacts and said connecting portion that connect said linking portions.

Preferably, a cross-section of said linking portions of said pair of said contacts and said connecting portion that connect said linking portions has a substantially U shape.

Preferably, said terminal portion and said signal-side terminal portion each have a press-fit structure to be pressed to inner peripheral surfaces of through holes of the circuit board.

According to the present invention, it is possible to reliably insert the terminal portions of the contacts into the through holes of the circuit board.

The above and other objects, features and advantages of the present invention will become more apparent from the following detailed description taken in conjunction with the accompanying drawings.

DETAILED DESCRIPTION OF THE PREFERRED EMBODIMENTS

A connector according to a preferred embodiment of the present invention will now be described in detail with reference to the drawings.

Figure 1:
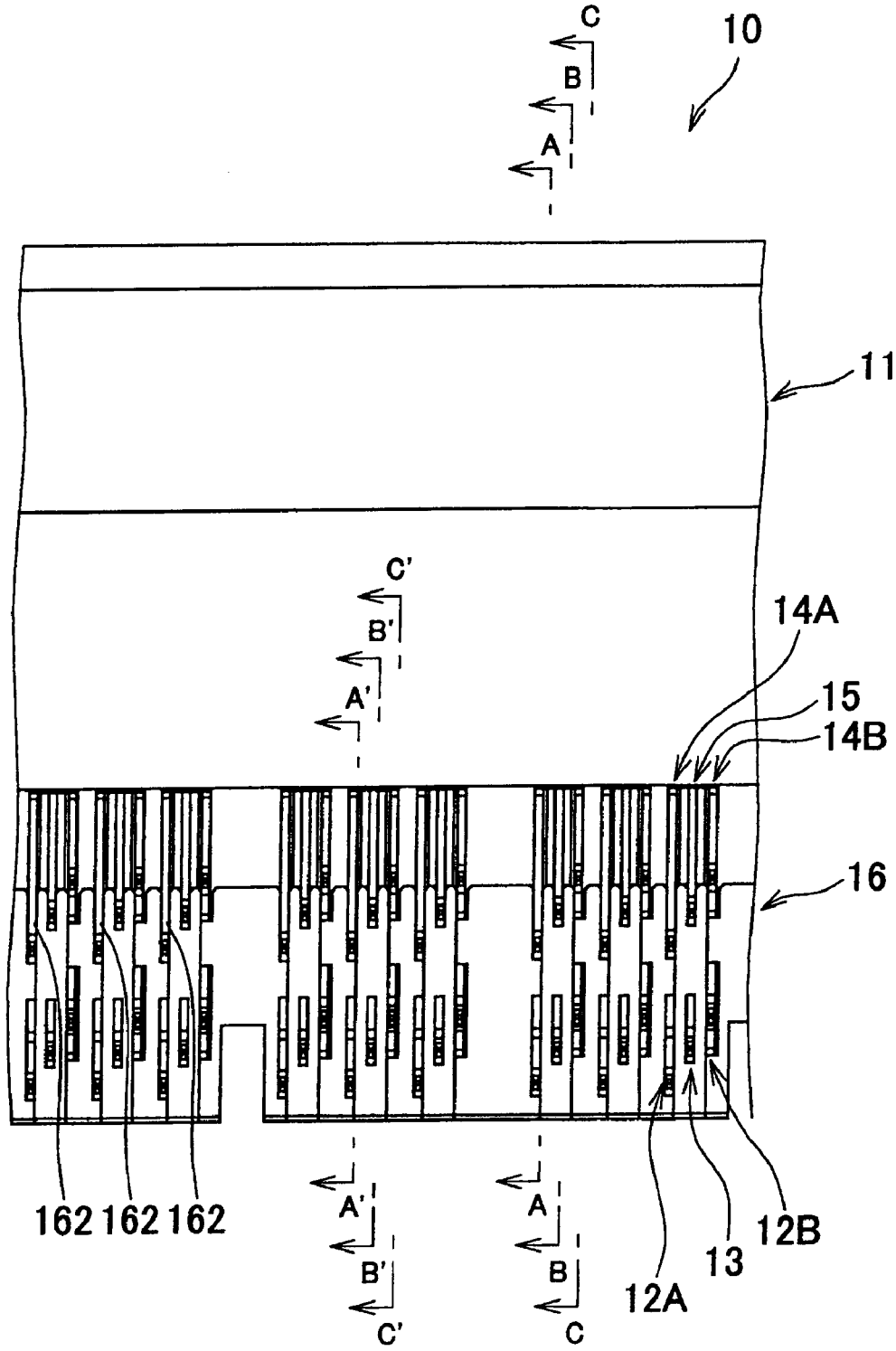
FIG. 1 is an enlarged view of part of a connector according to an embodiment of the present invention.
Figure 10:
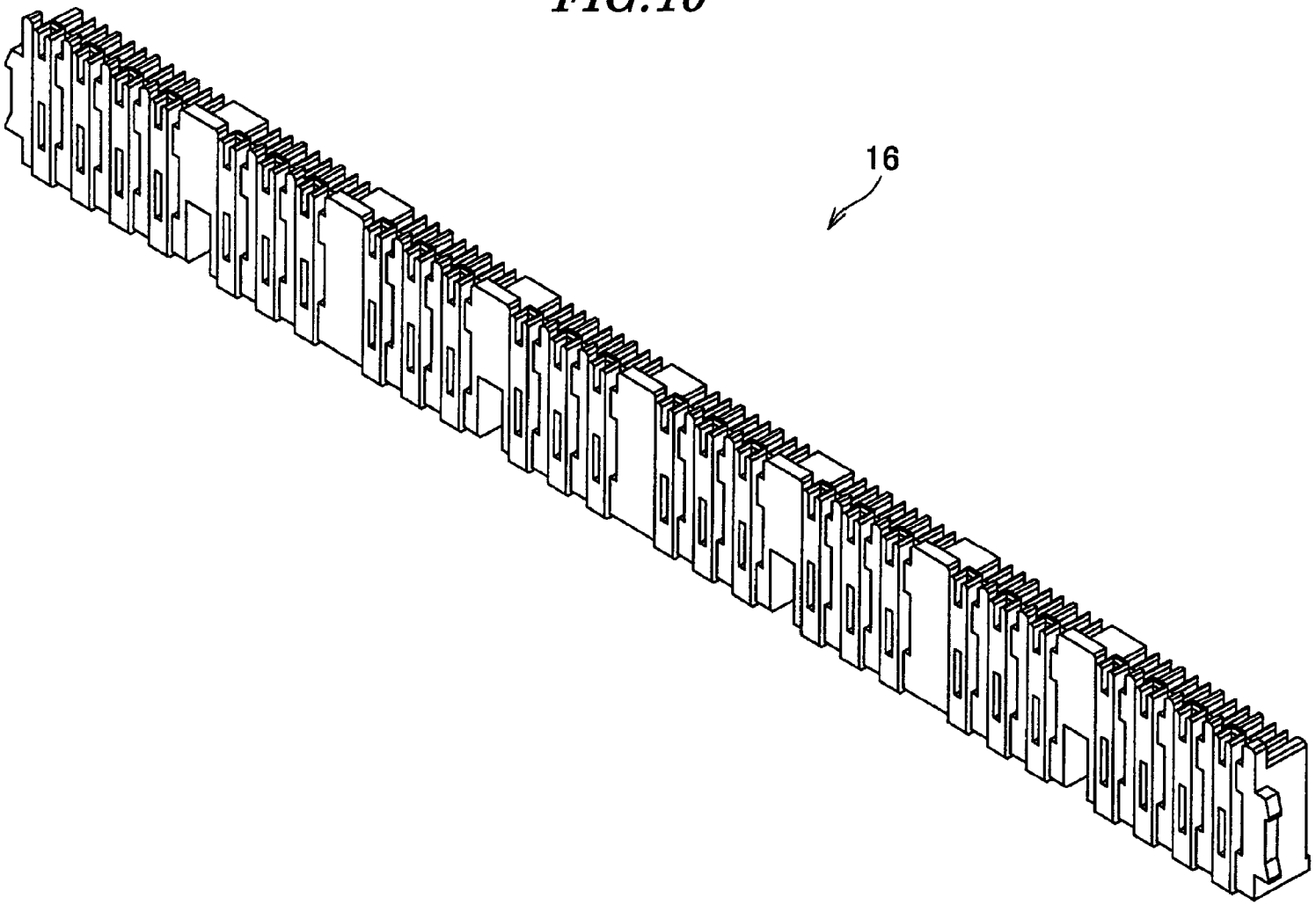
FIG. 10 is a perspective view of an alignment member of the connector shown in FIG. 1.

Referring to FIG. 1, reference numeral 10 denotes the connector which is comprised of a housing 11, first ground contacts (contacts) 12A, second ground contacts (contacts) 12B, first signal contacts 13, third ground contacts (contacts) 14A, fourth ground contacts (contacts) 14B, second signal contacts 15, and an alignment member 16 (see FIG. 10).

Figure 2:
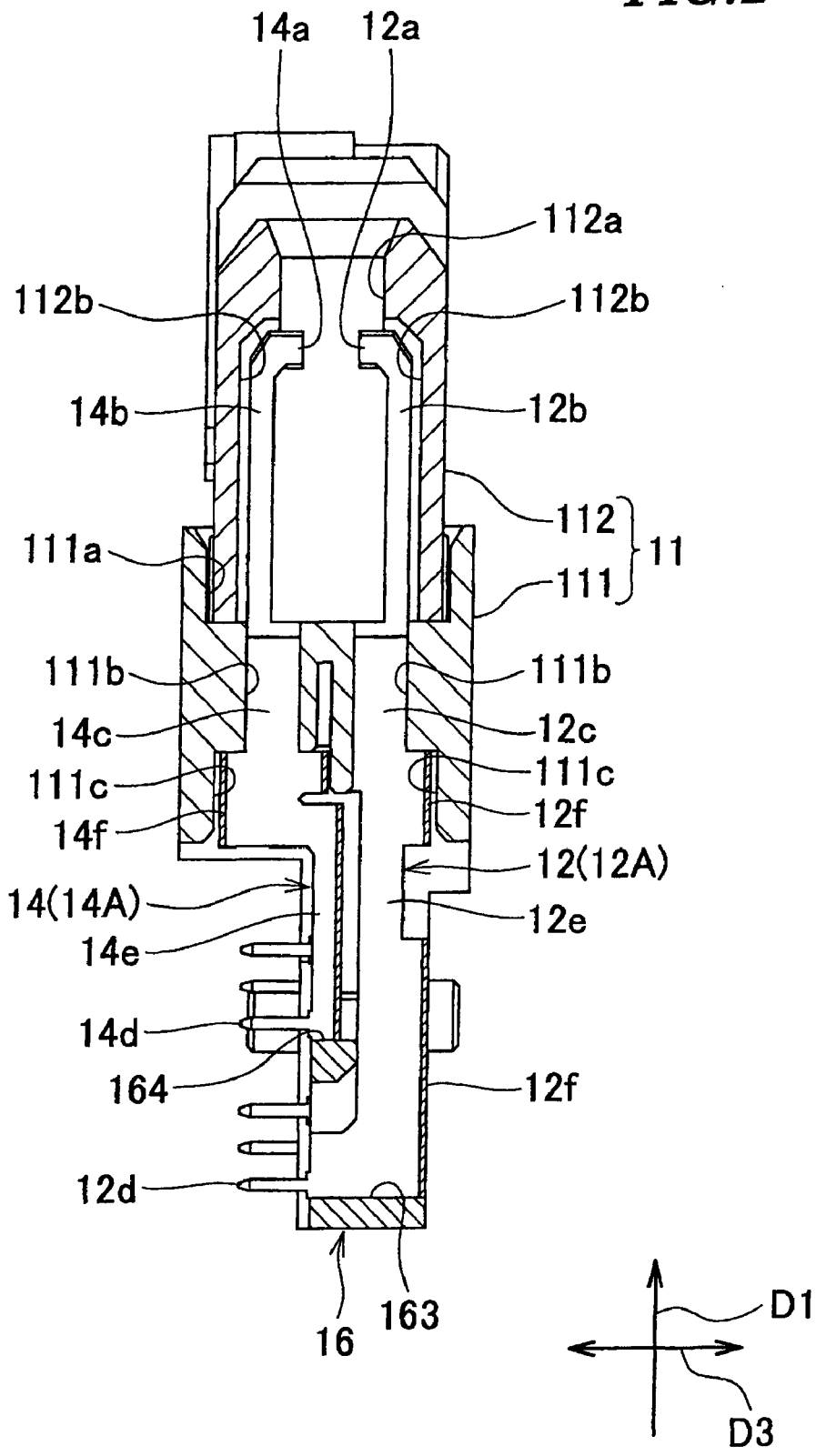
FIG. 2 is a cross-sectional view of the connector taken along line A-A in FIG. 1.

Referring to FIGS. 2 to 7, the housing 11 is comprised of a housing main body 111 and a fitting portion 112. In the present embodiment, when referring to the front, rear, top, and bottom sides of the connector 10, the upper, lower, right, and left sides of the connector 10 as viewed in FIG. 2 are referred to, respectively.

The housing main body 111 is formed of resin. The housing main body 111 has a recess 111*a* formed in a front portion thereof. Further, the housing main body 111 has a plurality of press-fitting holes 111*b* formed therein in two rows in the vertical direction thereof. The press-fitting holes 111*b* extend in a fitting direction D1, and communicate with the recess 111*a*. Also, the housing main body 111 has a plurality of holding holes 111*c* formed therein in two rows in the vertical direction thereof. The holding holes 111*c* extend in the fitting direction D1. The holding holes 111*c* are located rearward of the press-fitting holes 111*b* in the fitting direction D1 and communicate with the press-fitting holes 111*b*. Further, the housing main body 111 has a plurality of holding grooves 111*d* formed therein at predetermined space intervals in a longitudinal direction (predetermined direction) D2 of the connector 10 (see FIGS. 3 and 6). The plurality of holding grooves 111*d* are located upward of the press-fitting holes 111*b* in the lower row.

The fitting portion 112 is formed of resin. The fitting portion 112 is disposed in the recess 111*a* of the housing main body 111 such that it is movable in the longitudinal direction D2 of the connector 10. The fitting portion 112 has a plurality of receiving portions 112*a* formed therein. Receiving grooves 112*b* are formed in inner surfaces of each receiving portion 112*a*, which are opposed to each other in a vertical direction (terminal portion-inserting direction) D3. The receiving grooves 112*b* are disposed at predetermined space intervals in the longitudinal direction D2. The receiving grooves 112*b* are opposed to the press-fitting holes 111*b* of the housing main body 111 in the fitting direction D1.

Figure 8:
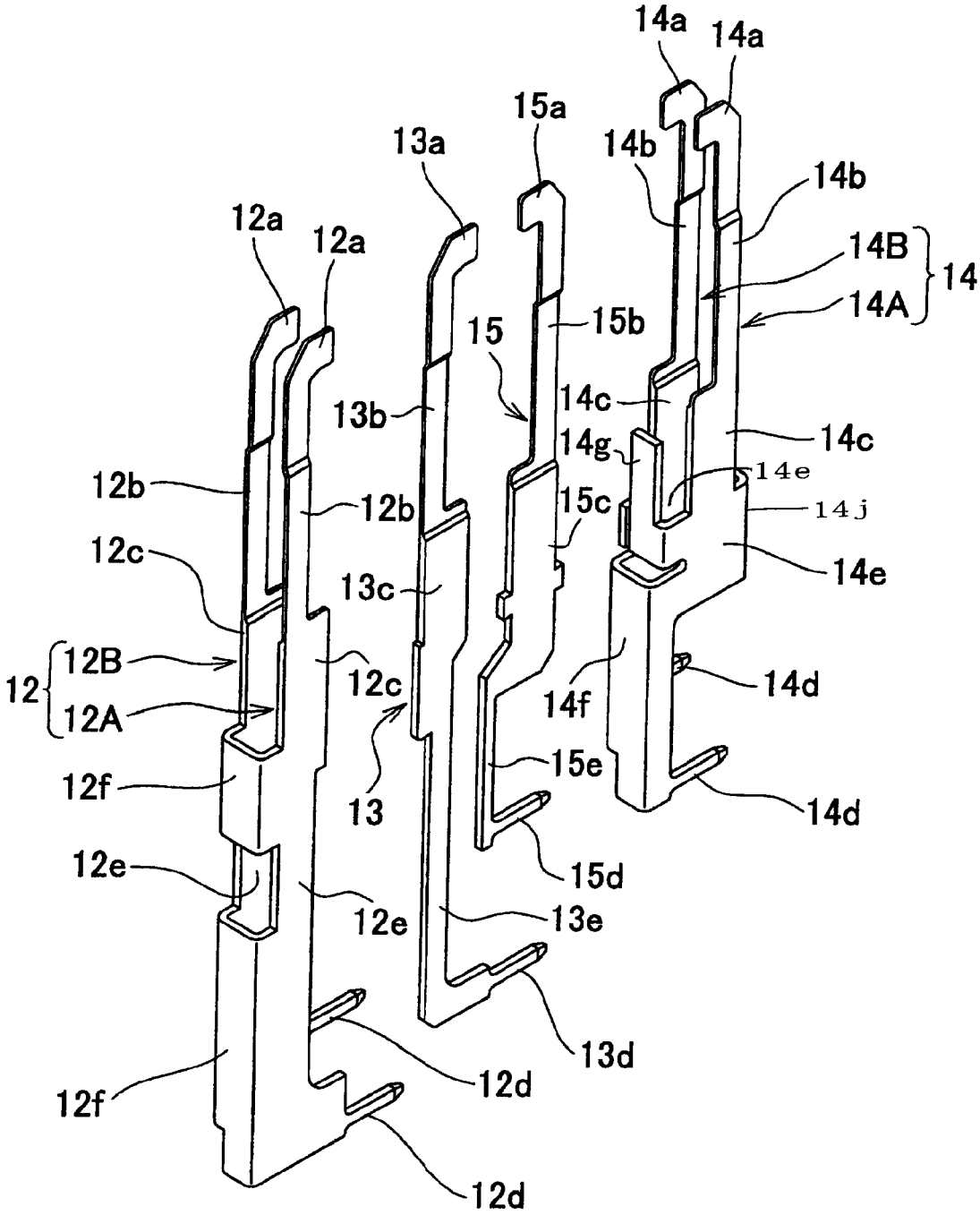
FIG. 8 is a perspective view of contacts of the connector shown in FIG. 1.
Figure 9:
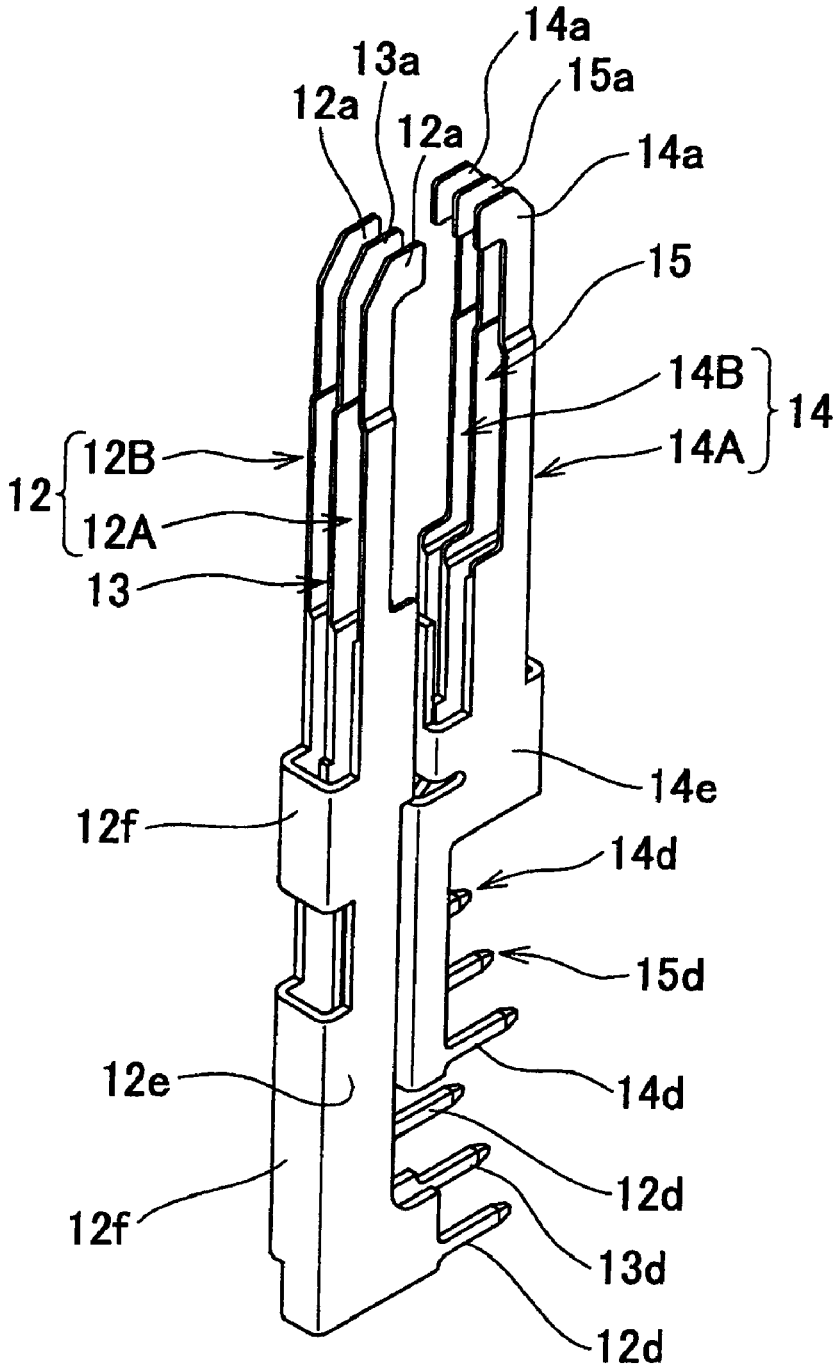
FIG. 9 is a perspective view of the contacts shown in FIG. 8 in a state in which the contacts are assembled.

Referring to FIGS. 8 and 9, each first ground contact 12A includes a contact portion 12*a*, a spring portion 12*b*, a holding portion 12*c*, a terminal portion 12*d*, and a linking portion 12*e*.

Figure 21:
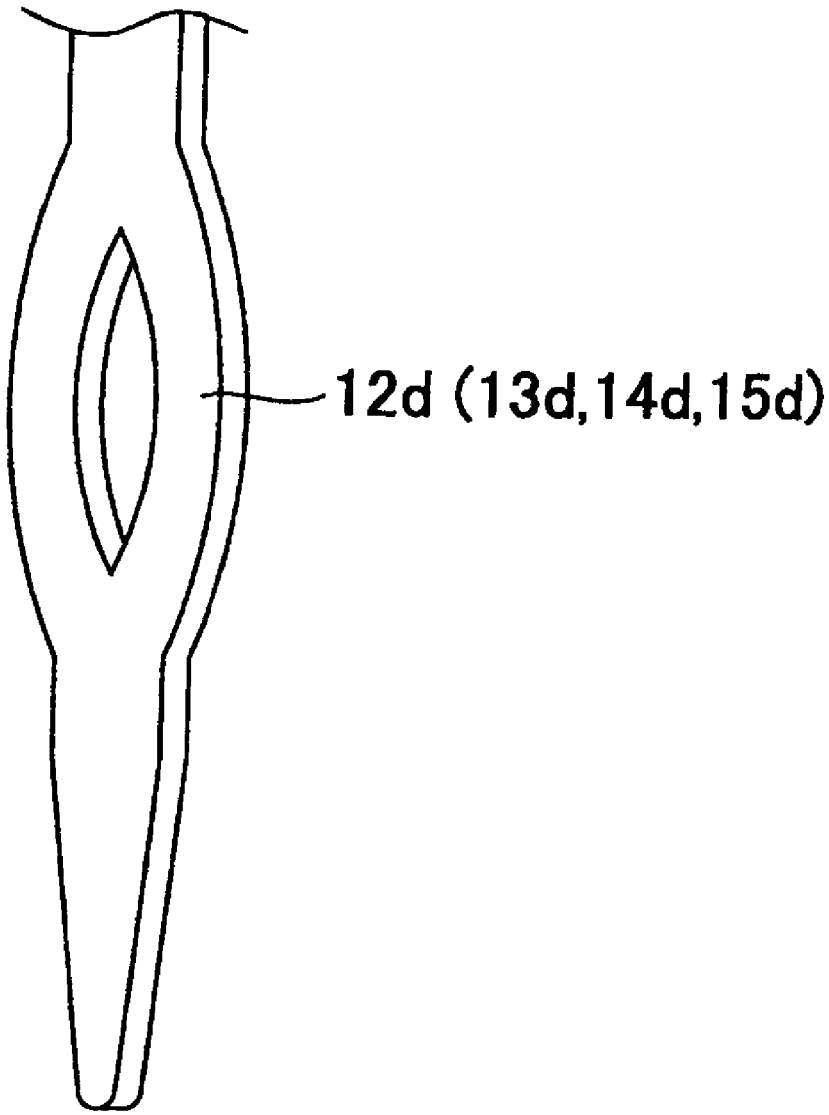
FIG. 21 is an enlarged view of a terminal portion of each contact of the connector shown in FIG. 1.

The contact portion 12*a* protrudes into an associated one of the receiving portions 112*a* of the fitting portion 112 (see FIG. 2). The spring portion 12*b* is continuous with the contact portion 12*a* and is received in an associated one of the receiving grooves 112*b* of the fitting portion 112. The holding portion 12*c* is continuous with the spring portion 12*b* and is press-fitted into an associated one of the press-fitting holes 111*b* of the housing main body 111 such that it is held in the housing main body 111. The terminal portion 12*d* is a terminal portion having a press-fit structure (the terminal portion is elastically deformed (or plastically deformed) to be press-fitted into a through hole of a circuit board, not shown such that it is held in the circuit board) (see FIG. 21). A longitudinal direction of the terminal portion 12*d* is substantially perpendicular to the fitting direction D1. The linking portion 12*e* connects the holding portion 12*c* and the terminal portion 12*d* to each other.

Each second ground contact 12B has substantially the same construction as that of the first ground contact 12A. Therefore, component parts of the second ground contact 12B identical to those of the first ground contact 12A are denoted by the same reference numerals in the figures, and detailed description thereof is omitted. The main difference between the first ground contact 12A and the second ground contact 12B is that the terminal portion 12*d* of the second ground contact 12B is located forward of the terminal portion 12*d* of the first ground contact 12A.

The first ground contact 12A and the second ground contact 12B i.e. predetermined (pair of) contacts, which are adjacent to each other in the longitudinal direction D2, are connected by a connecting portion 12*f*, to form a first combination contact (combination contact in the upper row) 12. The first combination contact 12 is formed by blanking and bending one metal plate.

Each first signal contact 13 includes a signal-side contact portion 13*a*, a signal-side spring portion 13*b*, a signal-side holding portion 13*c*, a signal-side terminal portion 13*d*, and a signal-side linking portion 13*e*.

Figure 3:
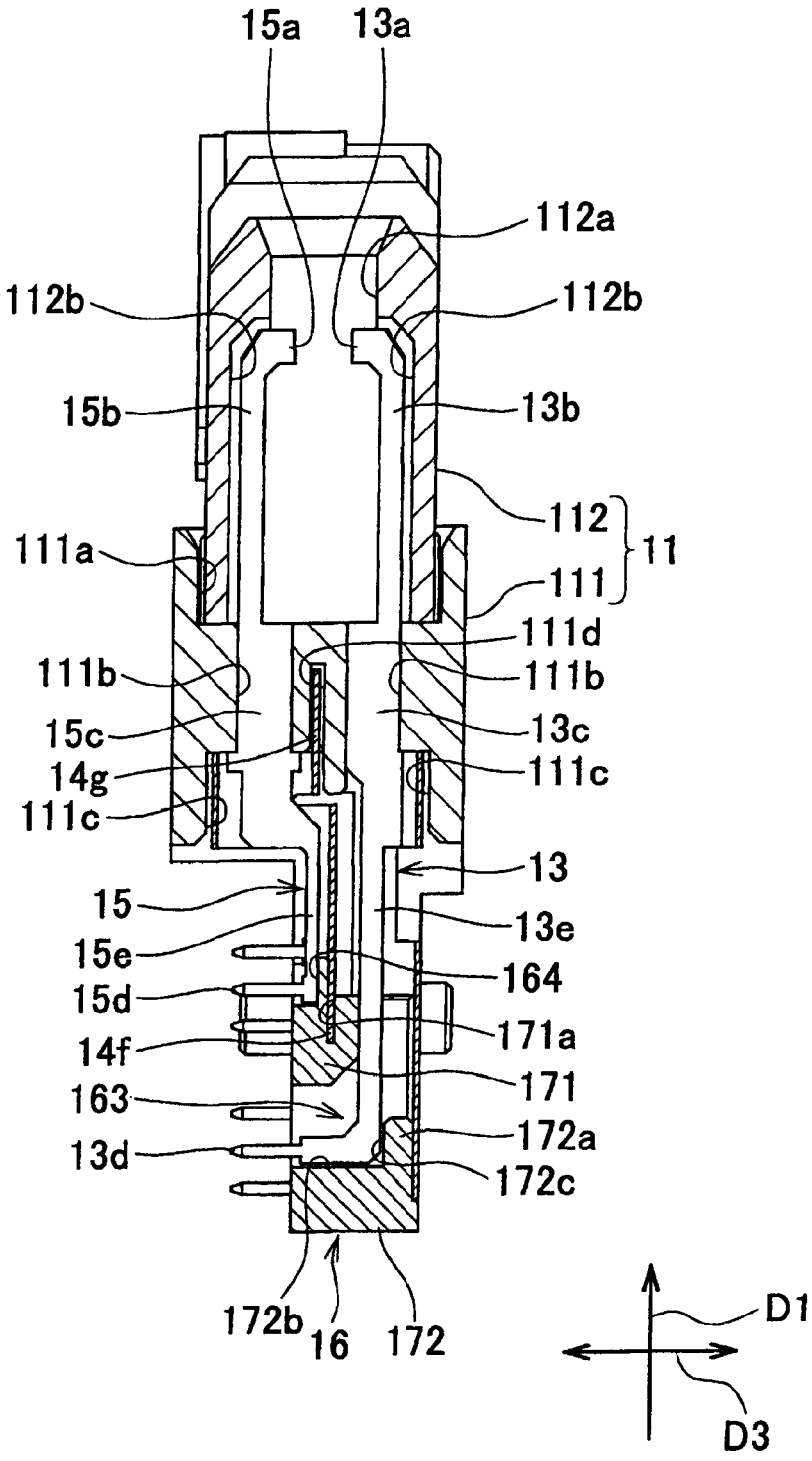
FIG. 3 is a cross-sectional view of the connector taken along line B-B in FIG. 1.
Figure 4:
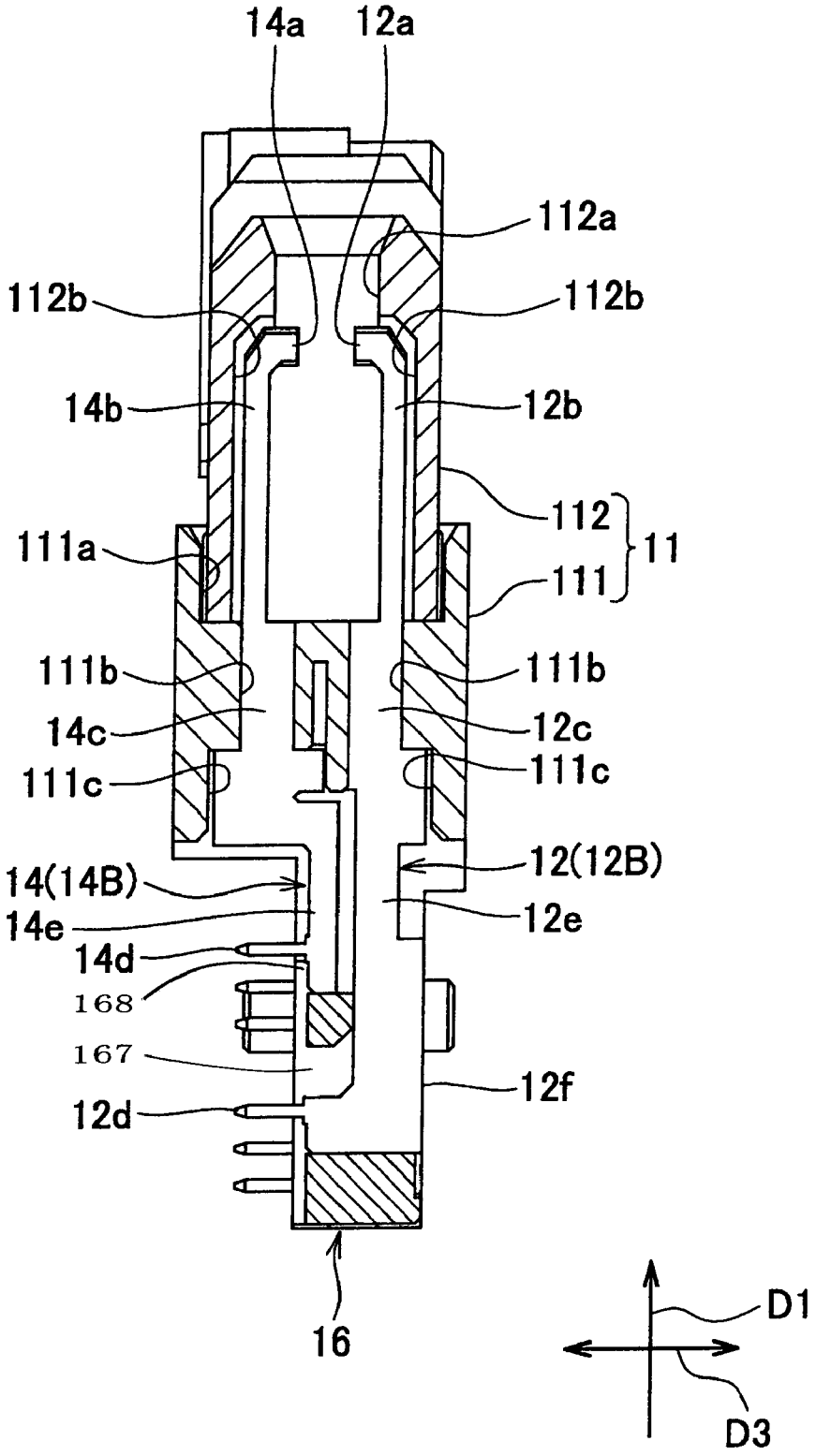
FIG. 4 is a cross-sectional view of the connector taken along line C-C in FIG. 1.
Figure 5:
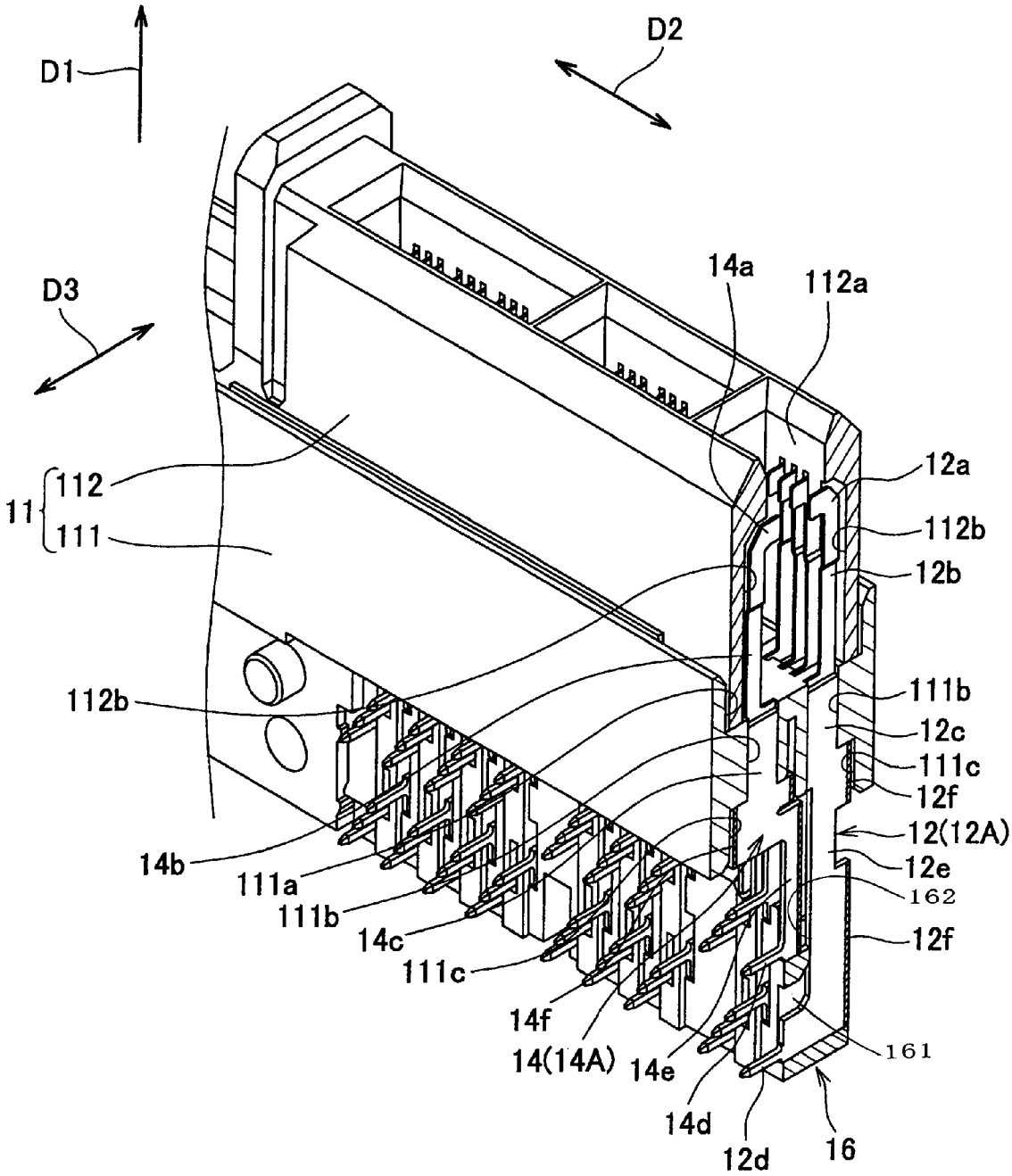
FIG. 5 is a perspective view of the connector partly in cross-section taken along line A-A shown in FIG. 1.

The signal-side contact portion 13*a* protrudes into the associated receiving portion 112*a* of the fitting portion 112 (see FIG. 3). The signal-side spring portion 13*b* is continuous with the signal-side contact portion 13*a* and is received into an associated one of the receiving grooves 112*b* of the fitting portion 112. The signal-side holding portion 13*c* is continuous with the signal-side spring portion 13*b*, and is press-fitted into an associated one of the press-fitting holes 111*b* of the housing main body 111 such that it is held in the housing main body 111. The signal-side terminal portion 13*d* is a terminal portion having the press-fit structure (see FIG. 21), and a longitudinal direction thereof is substantially perpendicular to the fitting direction D1. The signal-side linking portion 13*e* connects the signal-side holding portion 13*c* and the signal-side terminal portion 13*d* to each other.

The first signal contact 13 is formed by blanking and bending a metal plate.

Each third ground contact 14A includes a contact portion 14*a*, a spring portion 14*b*, a holding portion 14*c*, a terminal portion 14*d*, a linking portion 14*e*, and an insertion portion 14*g*.

The contact portion 14*a* protrudes into the associated receiving portion 112*a* of the fitting portion 112 (see FIG. 2). The spring portion 14*b* is continuous with the contact portion 14*a* and is received in an associated one of the receiving grooves 112*b* of the fitting portion 112. The holding portion 14*c* is continuous with the spring portion 14*b*, and is press-fitted into an associated one of the press-fitting holes 111*b* of the housing main body 111 such that it is held in the housing main body 111. The terminal portion 14*d* is a terminal portion having a press-fit structure (see FIG. 21), and a longitudinal direction thereof is substantially perpendicular to the fitting direction D1. The linking portion 14*e* connects the holding portion 14*c* and the terminal portion 14*d*. The insertion portion 14*g* is continuous with the linking portion 14*e* of the third ground contact 14A and extends substantially parallel to the spring portion 14*b*.

Each fourth ground contact 14B has substantially the same construction as that of the third ground contact 14A. Therefore, component parts of the fourth ground contact 14B identical to those of the third ground contact 14A are denoted by the same reference numerals in the figures, and detailed description thereof is omitted. The main differences between the third ground contact 14A and the fourth ground contact 14B are that the terminal portion 14*d* of the fourth ground contact 14B is located forward of the terminal portion 14*d* of the third ground contact 14A and that the fourth ground contact 14B lacks the insertion portion 14*g*.

The third ground contact 14A and the fourth ground contact 14B, i.e. predetermined (pair of) contacts which are adjacent to each other in the longitudinal direction D2 are connected by a connecting portion 14*f* continuous to an upper and rear portion of the linking portion 14*e* of the third ground contact 14A and a connecting portion 14*j* continuous to a lower and front portion of the same, to form a second combination contact (combination contact in the lower row) 14. One end portion of the linking portion 14*e* of the third ground contact 14A is continuous with the connecting portion 14*j*, the other end portion is continuous with the insertion portion 14*g*. One end portion of the linking portion 14*e* of the fourth ground contact 14B is continuous with the connecting portion 14*j*, the other end portion is not continuous with the insertion portion 14*g*. The second combination contact 14 is formed by blanking and bending a metal plate.

Each second signal contact 15 includes a signal-side contact portion 15*a*, a signal-side spring portion 15*b*, a signal-side holding portion 15*c*, a signal-side terminal portion 15*d*, and a signal-side linking portion 15*e*.

The signal-side contact portion 15*a* protrudes into the associated receiving portion 112*a* of the fitting portion 112 (see FIG. 3). The signal-side spring portion 15*b* is continuous with the signal-side contact portion 15*a* and is received in an associated one of the receiving grooves 112*b* of the fitting portion 112. The signal-side holding portion 15*c* is continuous with the signal-side spring portion 15*b*, and is press-fitted into an associated one of the press-fitting holes 111*b* of the housing main body 111 such that it is held in the housing main body 111. The signal-side terminal portion 15*d* is a terminal portion having a press-fit structure (see FIG. 21), and a longitudinal direction thereof is substantially perpendicular to the fitting direction D1. The signal-side linking portion 15*e* connects the signal-side holding portion 15*c* and the signal-side terminal portion 15*d*.

The second signal contact 15 is formed by blanking and bending a metal plate.

Referring to FIGS. 10 to 13, the alignment member 16 includes a plurality of first receiving portions 161, a plurality of second receiving portions 162, a plurality of first signal-side receiving portions 163, a plurality of second signal-side receiving portions 164, a plurality of third receiving portions 167, a plurality of fourth receiving portions 168, and a plurality of open portions 169.

Figure 11:
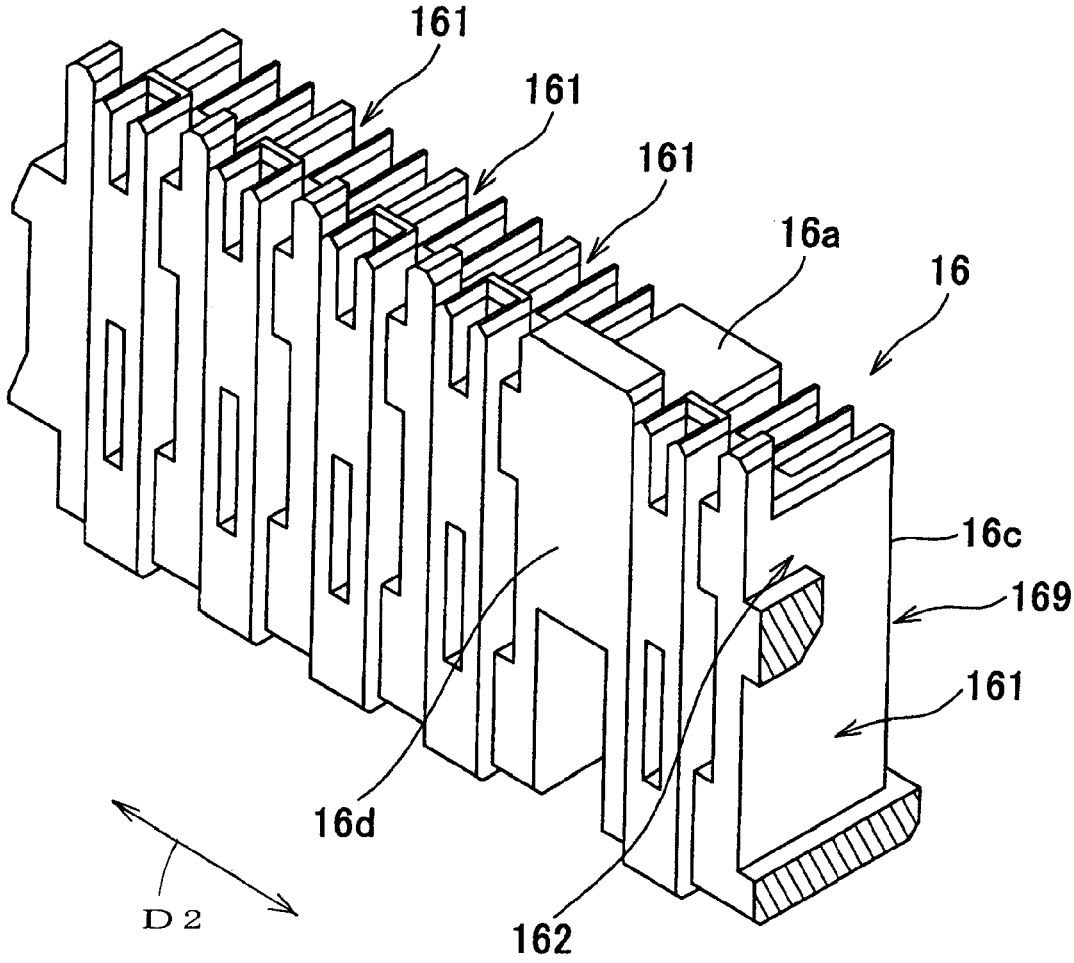
FIG. 11 is a perspective view of the alignment member partly in cross-section taken along line A'-A' in FIG. 1.

As shown in FIGS. 11 and 1, the plurality of first receiving portions 161 are formed at predetermined space intervals along the longitudinal direction D2. Each first receiving portion 161 opens in a front surface 16*a*, an upper surface 16*c*, and a lower surface 16*d* of the alignment member 16. Each first receiving portion 161 receives a rear portion of the linking portion 12*e* of an associated one of the first ground contacts 12A (see FIGS. 2 and 5). The plurality of second receiving portions 162 are formed at predetermined space intervals along the longitudinal direction D2. Each second receiving portion 162 is continuous with an associated one of the first receiving portions 161 and opens in the front surface 16*a*, the lower surface 16*d*, and the upper surface 16*c* of the alignment member 16. Each second receiving portion 162 receives a rear portion of the linking portion 14*e* of an associated one of the third ground contacts 14A (see FIGS. 2 and 5).

Figure 12:
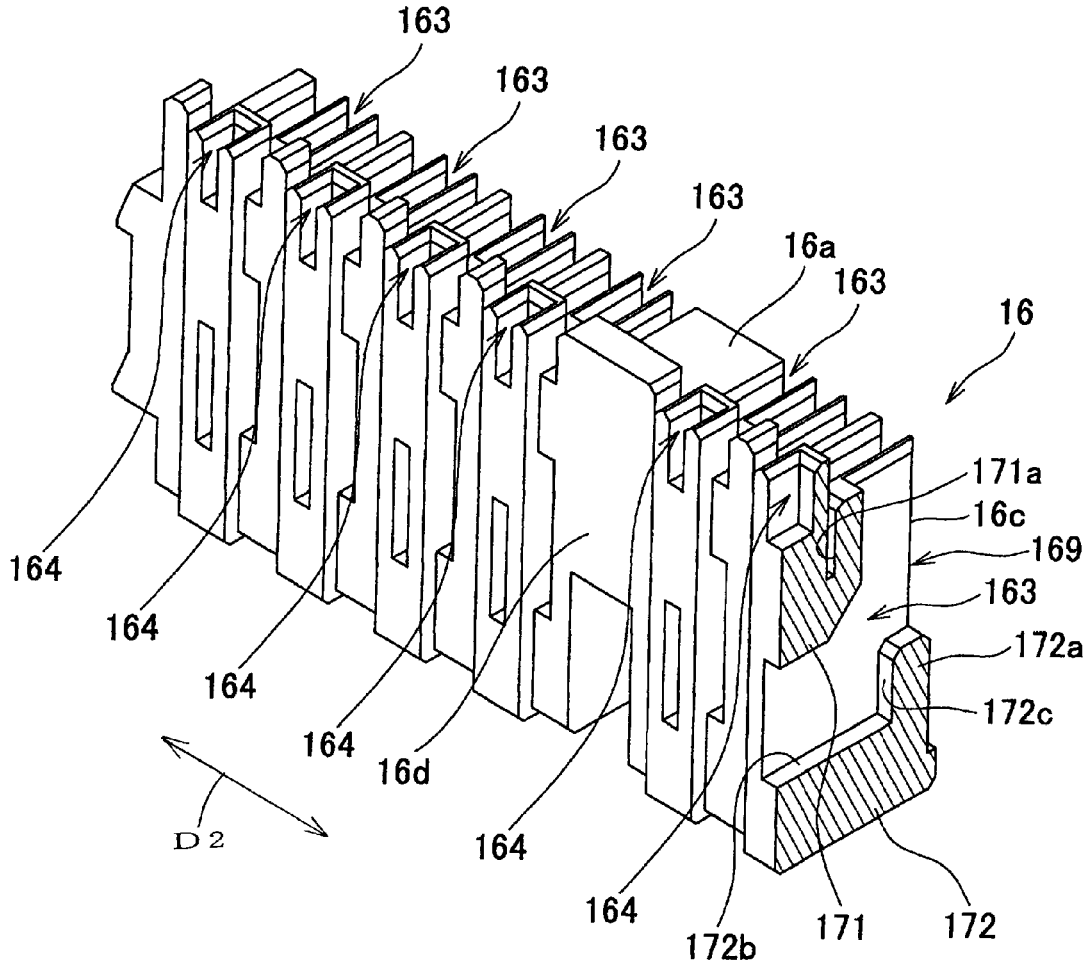
FIG. 12 is a perspective view of the alignment member partly in cross-section taken along line B'-B' in FIG. 1.

Referring to FIG. 12, the plurality of first signal-side receiving portions 163 are formed at predetermined space intervals along the longitudinal direction D2. Each first signal-side receiving portion 163 has a substantially L shape and opens in the front surface 16*a*, the upper surface 16*c*, and the lower surface 16*d* of the alignment member 16. Each first signal-side receiving portion 163 receives a rear portion of the signal-side linking portion 13*e* of an associated one of the first signal contacts 13 (see FIGS. 3 and 6). The plurality of second signal-side receiving portions 164 are formed at predetermined space intervals along the longitudinal direction D2. Each second signal-side receiving portion 164 is formed in a front portion of the alignment member 16 and opens in the front surface 16*a* and the lower surface 16*d* of the alignment member 16. Each second signal-side receiving portion 164 receives a rear portion of the signal-side linking portion 15*e* of an associated one of the second signal contacts 15 (see FIGS. 3 and 6).

A groove 171*a* is formed in a linking portion 171 that connects two inner surfaces of each first signal-side receiving portion 163 opposed to each other in the longitudinal direction D2. A linking portion 172 located rearward of each first signal-side receiving portion 163 includes a protruding portion 172*a*. The groove 171*a* receives a rear portion of the connecting portion 14*f* of an associated one of the second combination contacts 14 and prevents the second combination contact 14 from moving upward relative to the alignment member 16. Thus, a movement preventing portion that prevents the upward movement of the second combination contact 14 is formed by an inner surface of each groove 171*a*.

Figure 13:
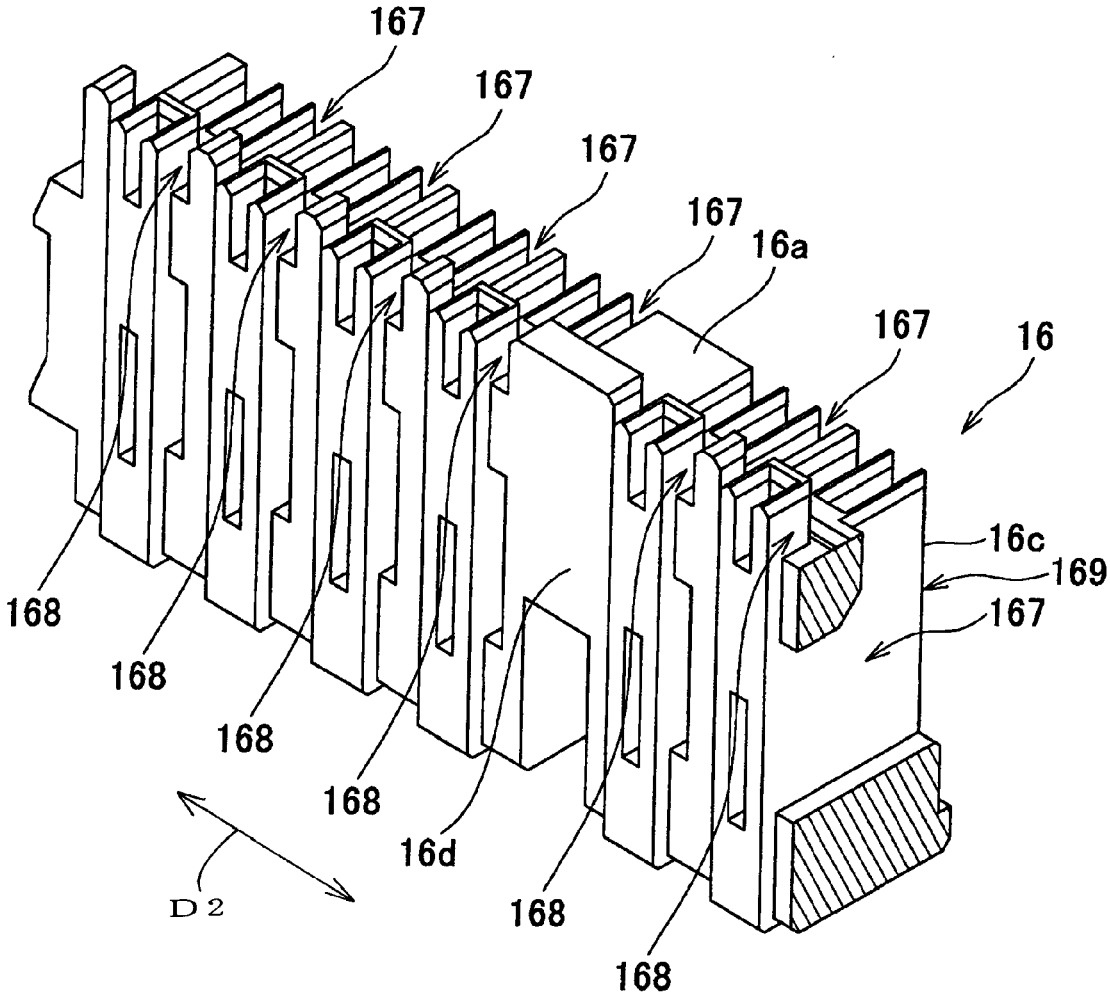
FIG. 13 is a perspective view of the alignment member partly in cross-section taken along line C'-C' in FIG. 1.

Referring to FIG. 13, the plurality of third receiving portions 167 are formed at predetermined space intervals along the longitudinal direction D2. Each third receiving portion 167 has a substantially L shape and opens in the front surface 16*a*, the upper surface 16*c*, and the lower surface 16*d* of the alignment member 16. Each third receiving portion 167 receives a rear portion of the linking portion 12*e* of an associated one of the second ground contacts 12B (see FIGS. 4 and 7). The plurality of fourth receiving portions 168 are formed at predetermined space intervals along the longitudinal direction D2. Each fourth receiving portion 168 is formed in the front portion of the alignment member 16 and opens in the front surface 16*a* and the lower surface 16*d* of the alignment member 16. Each fourth receiving portion 168 receives a rear portion of the linking portion 14*e* of an associated one of the fourth ground contacts 14B (see FIGS. 4 and 7).

As described above, the first receiving portions 161, the first signal-side receiving portions 163, and the third receiving portions 167 have respective openings in the upper surface 16*c* of the alignment member 16, and these openings form the open portions 169.

To assemble the connector 10, first, as shown in FIGS. 2, 4, 5, and 7, the holding portions 12*c* and 12*c* of each first combination contact 12 are press-fitted into an associated one of the press-fitting holes 111*b* in the upper row of the housing main body 111, and the holding portions 14*c* and 14*c* of each second combination contact 14 are press-fitted into respective associated ones of the press-fitting holes 111*b* in the lower row of the housing main body 111. At this time, the spring portions 12*b* and 12*b* of each first combination contact 12 are inserted into respective associated ones of the receiving grooves 112*b* in the upper row of the fitting portion 112, and front portions of the linking portions 12*e*, 12*e* and the connecting portion 12*f* of the first combination contact 12 are inserted into the associated holding hole 111*c* in the upper row. Also, the spring portions 14*b* and 14*b* of each second combination contact 14 are inserted into respective associated ones of the receiving grooves 112*b* in the lower row of the fitting portion 112, and front portions of the linking portions 14*e*, 14*e* and the connecting portion 14*j* of the second combination contact 14 are inserted into the associated holding hole 111*c* in the lower row. Further, the insertion portion 14*g* of each second combination contact 14 is inserted into an associated one of the holding grooves 111*d* (see FIGS. 3 and 6).

Figure 6:
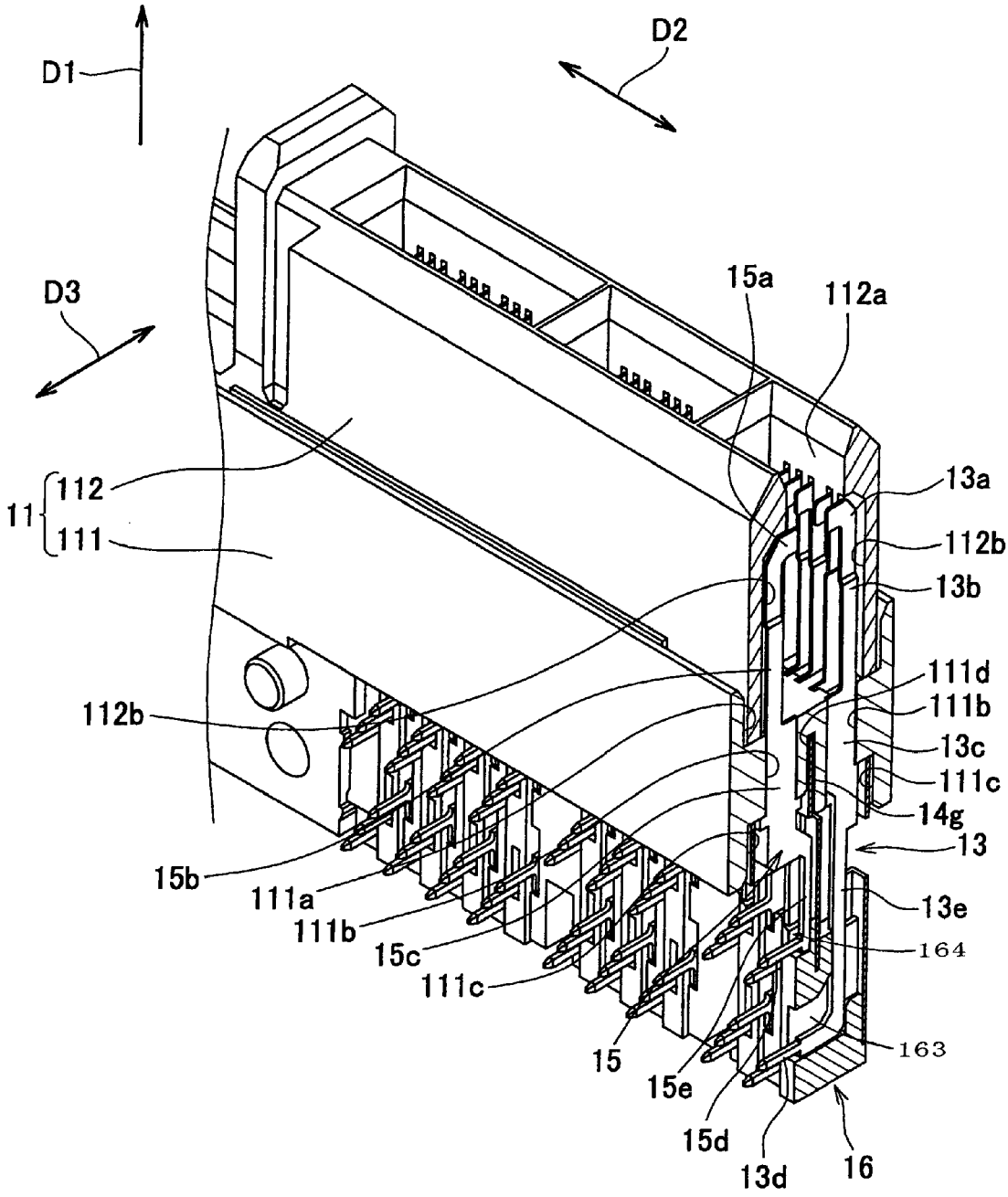
FIG. 6 is a perspective view of the connector partly in cross-section taken along line B-B shown in FIG. 1.
Figure 7:
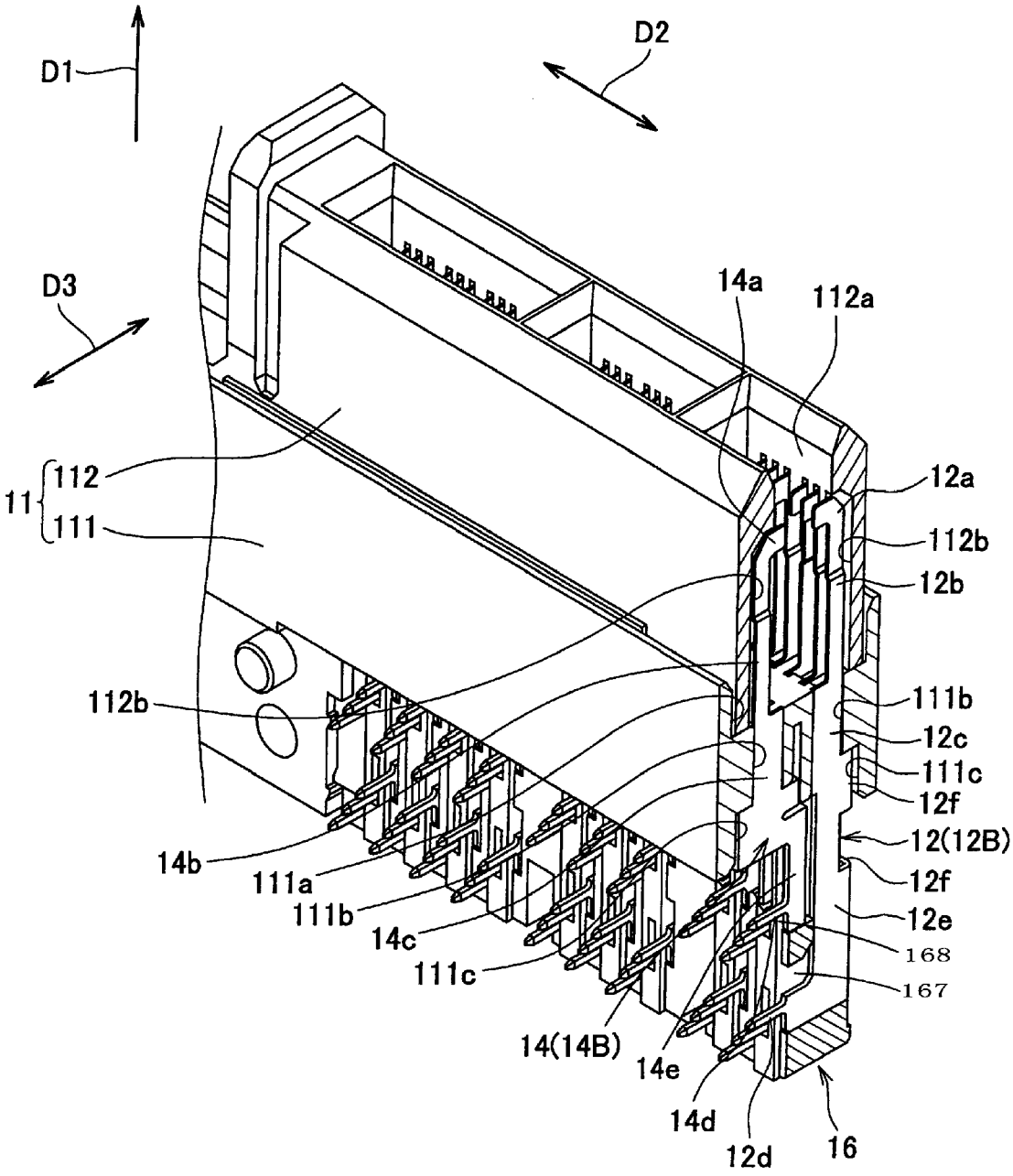
FIG. 7 is a perspective view of the connector partly in cross-section taken along line C-C shown in FIG. 1.

Further, as shown in FIGS. 3 and 6, the signal-side holding portion 13*c* of each first signal contact 13 is press-fitted into an associated one of the press-fitting holes 111*b* in the upper row of the housing main body 111, and the signal-side holding portion 15*c* of each second signal contact 15 is press-fitted into an associated one of the press-fitting holes 111*b* in the lower row of the housing main body 111. At this time, the signal-side spring portion 13*b* of each first signal contact 13 is inserted into an associated one of the receiving grooves 112*b* in the upper row of the fitting portion 112, and a front portion of the signal-side linking portion 13*e* of each first signal contact 13 is inserted into an associated one the holding holes 111*c* in the upper row of the housing main body 111. Also, the signal-side spring portion 15*b* of each second signal contact 15 is inserted into an associated one of the receiving grooves 112*b* in the lower row of the fitting portion 112, and a front portion of the signal-side linking portion 15*e* of each second signal contact 15 is inserted into an associated one of the holding holes 111*c* in the lower row of the housing main body 111.

Finally, the respective rear portions of the linking portions 12*e* and 12*e* of each first combination contact 12, the rear portion of the signal-side linking portion 13*e* of each first signal contact 13, the respective rear portions of the linking portions 14*e* and 14*e* of each second combination contact 14, and the rear portion of the signal-side linking portion 15*e* of each second signal contact 15 are respectively inserted into the first and third receiving portions 161, 167, the first signal-side receiving portion 163, the second and fourth receiving portions 162 and 168, and the second signal-side receiving portion 164 of the alignment member 16.

The process of inserting the contacts into the alignment member 16 is performed in accordance with the following procedure.

First, the terminal portions 12*d* and 12*d* of each first combination contact 12 and the signal-side terminal portion 13*d* of each first signal contact 13 are respectively inserted into the first receiving portions 161, the third receiving portions 167, and the first signal-side receiving portions 163 of the alignment member 16 from the front side, and the terminal portions 12*d*, 12*d*, and 13*d* are pushed in along the fitting direction D1 until the rear portion of the signal-side linking portion 13*e* of the first signal contact 13 is brought into abutment with an associated one of the protruding portions 172*a* of the alignment member 16.

Next, all of the contacts 12, 13, 14, and 15 are pressed in downward along the vertical direction D3 until the signal-side linking portion 13*e* of the first signal contact 13 is brought into abutment with an associated one of the linking portions 171.

Finally, all of the contacts 12, 13, 14, and 15 are pressed in rearward along the fitting direction D1 until the rear portion of the signal-side linking portion 13*e* of the first signal contact 13 is brought into abutment with a supporting surface 172*b* (see FIG. 3) of an associated one of the linking portions 172. At this time, the rear portion of the signal-side linking portion 13*e* of the first signal contact 13 is brought into contact with a supporting surface 172*c* (see FIG. 3) of an associated one of the protruding portions 172*a*, whereby an upward movement of the first signal contact 13 is prevented. Also, the rear portion of the connecting portion 14*f* of the second combination contact 14 fits in an associated one of the grooves 171*a*, whereby an upward movement of the second combination contact 14 is prevented. Further, a rear end portion of the signal-side linking portion 15*e* of the second signal contact 15 is received in an associated one of the second signal-side receiving portions 164, whereby an upward movement of the second signal contacts 15 is prevented.

To press-fit the terminal portions 12*d*, 13*d*, 14*d*, and 15*d* of the first combination contacts 12, the first signal contacts 13, the second combination contacts 14, and the second signal contacts 15 into through holes of a printed board, not shown, first, a front end portion of each of the terminal portions 12*d*, 13*d*, 14*d*, and 15*d* is inserted into the through holes.

Next, all of the connecting portions 12*f* of the first combination contacts 12 that are exposed outside through the open portions 169 are simultaneously pressed downward by using a plate-shaped jig (not shown).

The pressing force acting on the connecting portions 12*f* via the jig is applied to the terminal portions 12*d* via the linking portions 12*e*.

Also, the connecting portions 12*f* pressed by the jig press the alignment member 16. At this time, the supporting surfaces 172*c* of the protruding portions 172*a*, the inner surfaces of the grooves 171*a* of the linking portions 171, and the inner surfaces of the second signal-side receiving portions 164 of the alignment member 16 press the first signal contacts 13, the second combination contacts 14, and the second signal contacts 15, respectively.

As a result of the aforementioned process, the terminal portions 12*d*, 13*d*, 14*d*, and 15*d* are elastically deformed (or plastically deformed), whereby the terminal portions 12*d*, 13*d*, 14*d*, and 15*d* are press-fitted into the through holes.

Figure 15:
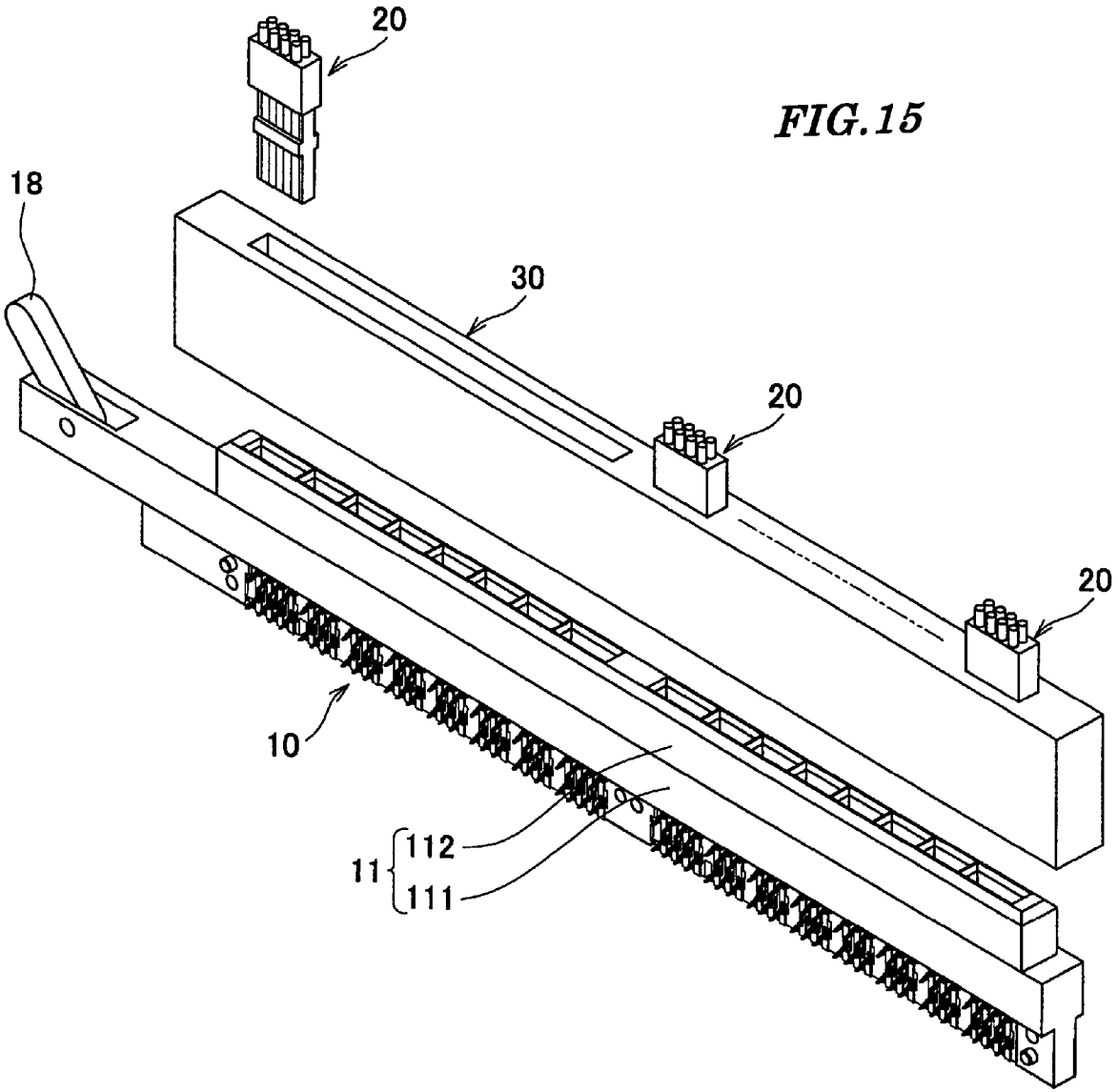
FIG. 15 is a schematic diagram showing a state before a mating connector is connected to the connector shown in FIG. 1.
Figure 16:
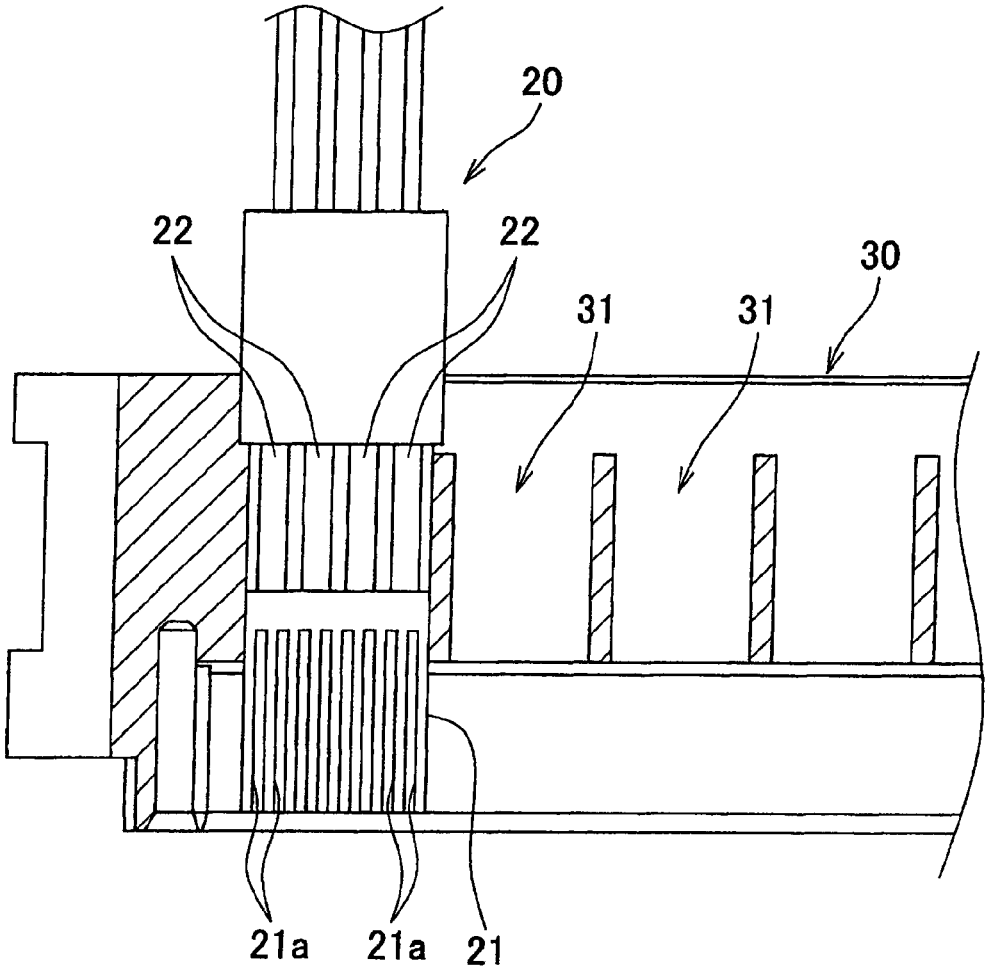
FIG. 16 is a schematic diagram showing a state in which the mating connector is fitted to a relay housing appearing in FIG. 15.

As shown in FIGS. 15 and 16, to connect the connector 10 to cable connectors 20, which are mating connectors, first, the cable connectors 20 are respectively inserted into a plurality of receiving portions 31 of a relay housing 30.

Figure 17:
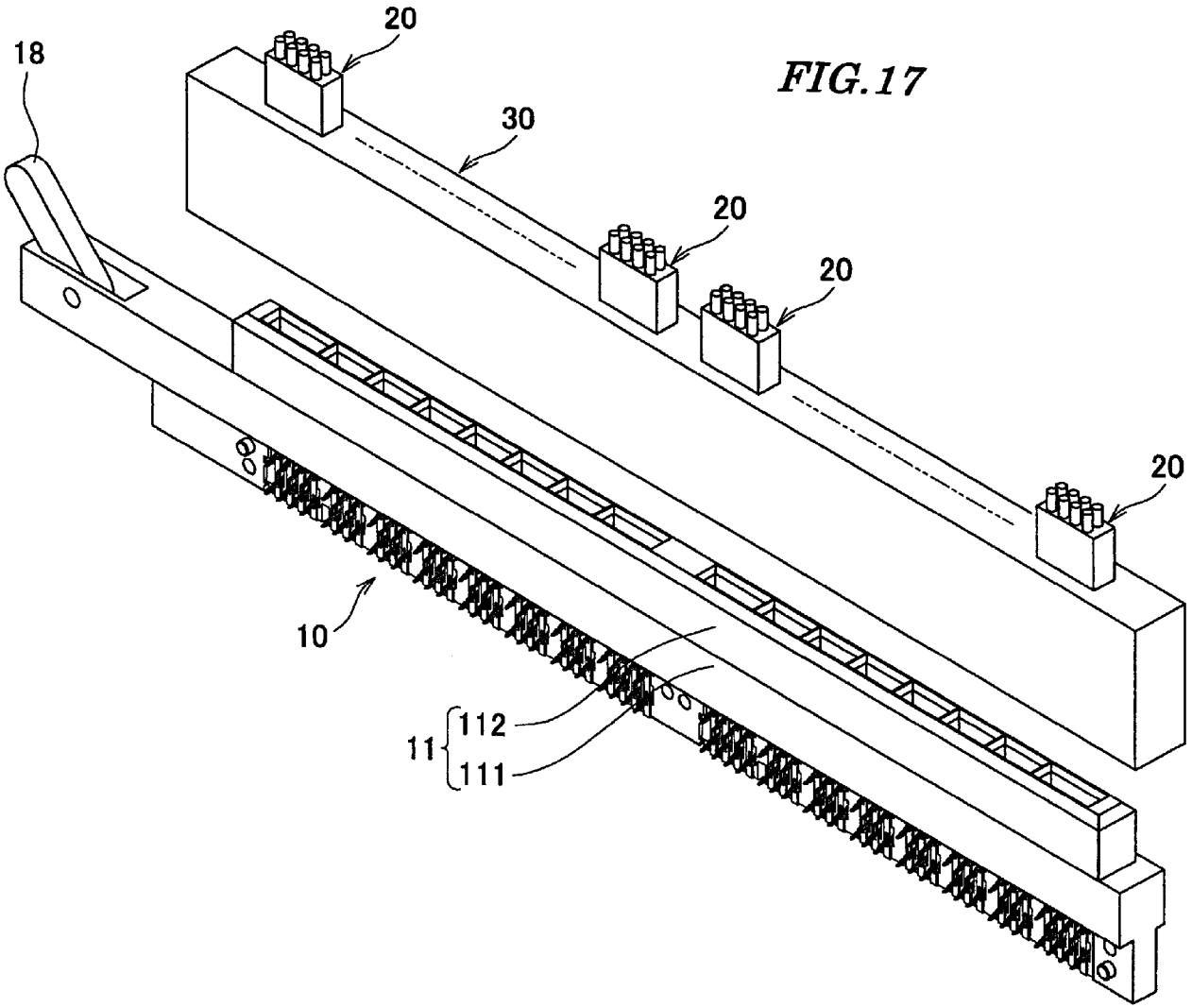
FIG. 17 is a schematic diagram showing a state before the mating connector shown in FIG. 15 is connected to the connector shown in FIG. 1.

As shown in FIG. 17, after all of the cable connectors 20 are inserted into the relay housing 30, the fitting portion 112 of the connector 10 is placed on a fitting position. At this time, the spring portions 12*b*, 13*b*, 14*b*, and 15*b* of the first combination contacts 12, the first signal contacts 13, the second combination contacts 14, and the second signal contacts 15 are not elastically deformed and are in a straight state (see FIG. 19).

Figure 18:
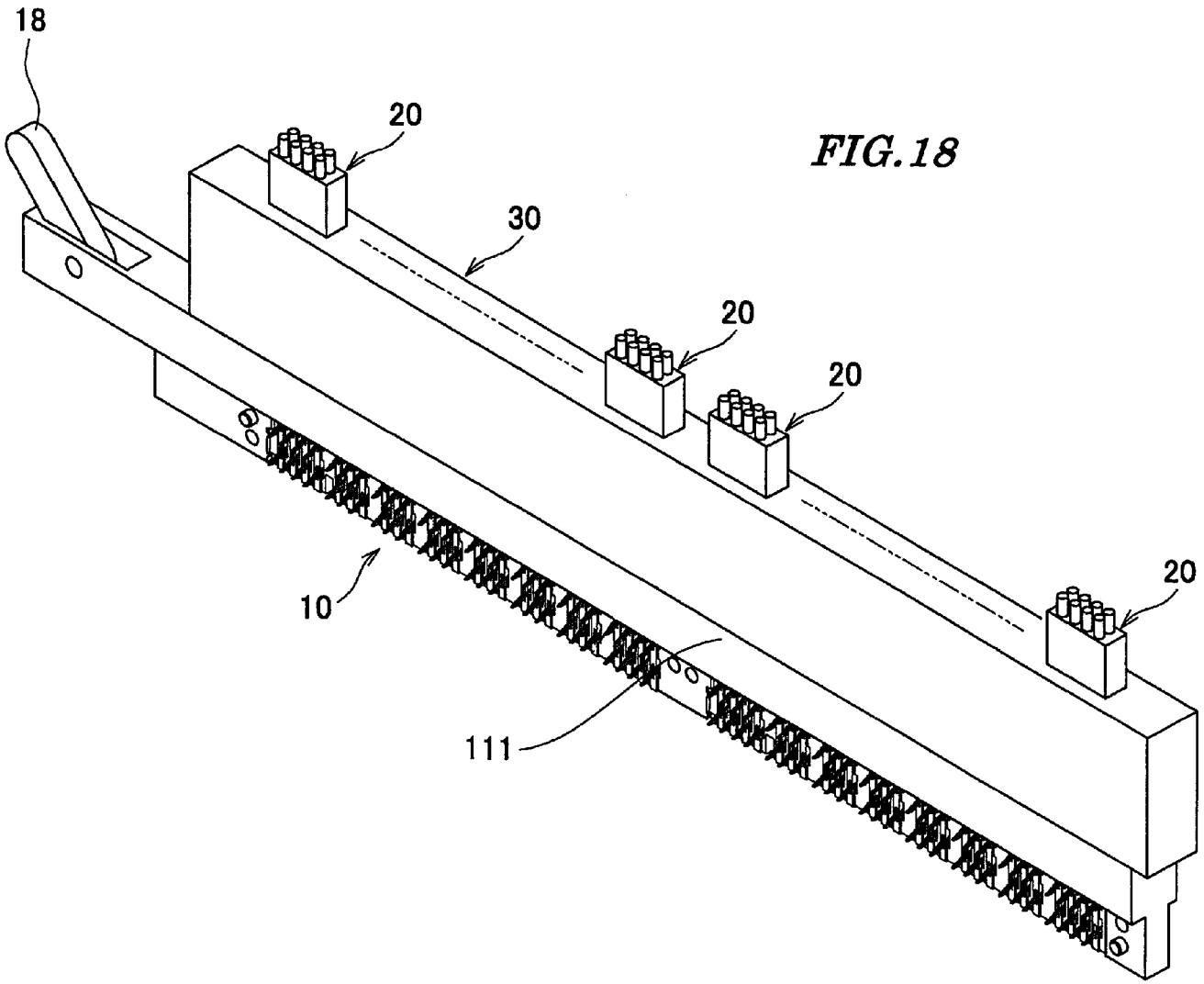
FIG. 18 is a schematic diagram showing a state in which the mating connector shown in FIG. 15 is connected to the connector shown in FIG. 1.
Figure 19:
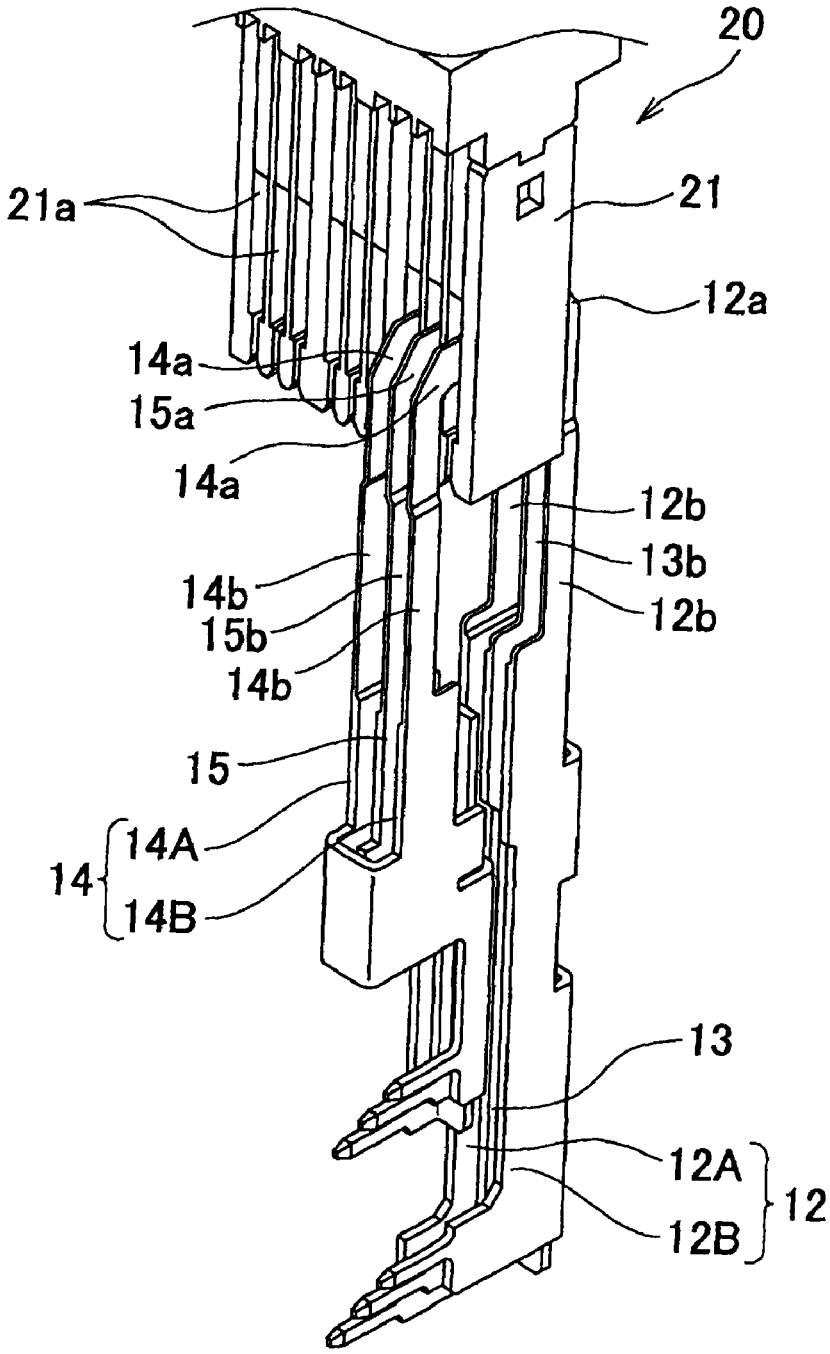
FIG. 19 is a perspective view showing a state in which contacts of the connector shown in FIG. 1 are inserted into the mating connector shown in FIG. 15.

Next, the relay housing 30 is fitted to the fitting portion 112 of the connector 10 (see FIG. 18). As a result, as shown in FIG. 19, the contact portions 12*a*, 13*a*, 14*a*, and 15*a* of the first combination contacts 12, the first signal contacts 13, the second combination contacts 14, and the second signal contacts 15 are respectively inserted into a plurality of slits 21*a* formed in a housing 21 of each cable connector 20. In the slits 21*a*, contact portions (not shown) of contacts 22 (see FIG. 16) of the cable connectors 20 are disposed.

Finally, a lever 18 of the connector 10 is rotated in a predetermined direction to cause the fitting portion 112 to slide in the longitudinal direction D2.

Figure 20:
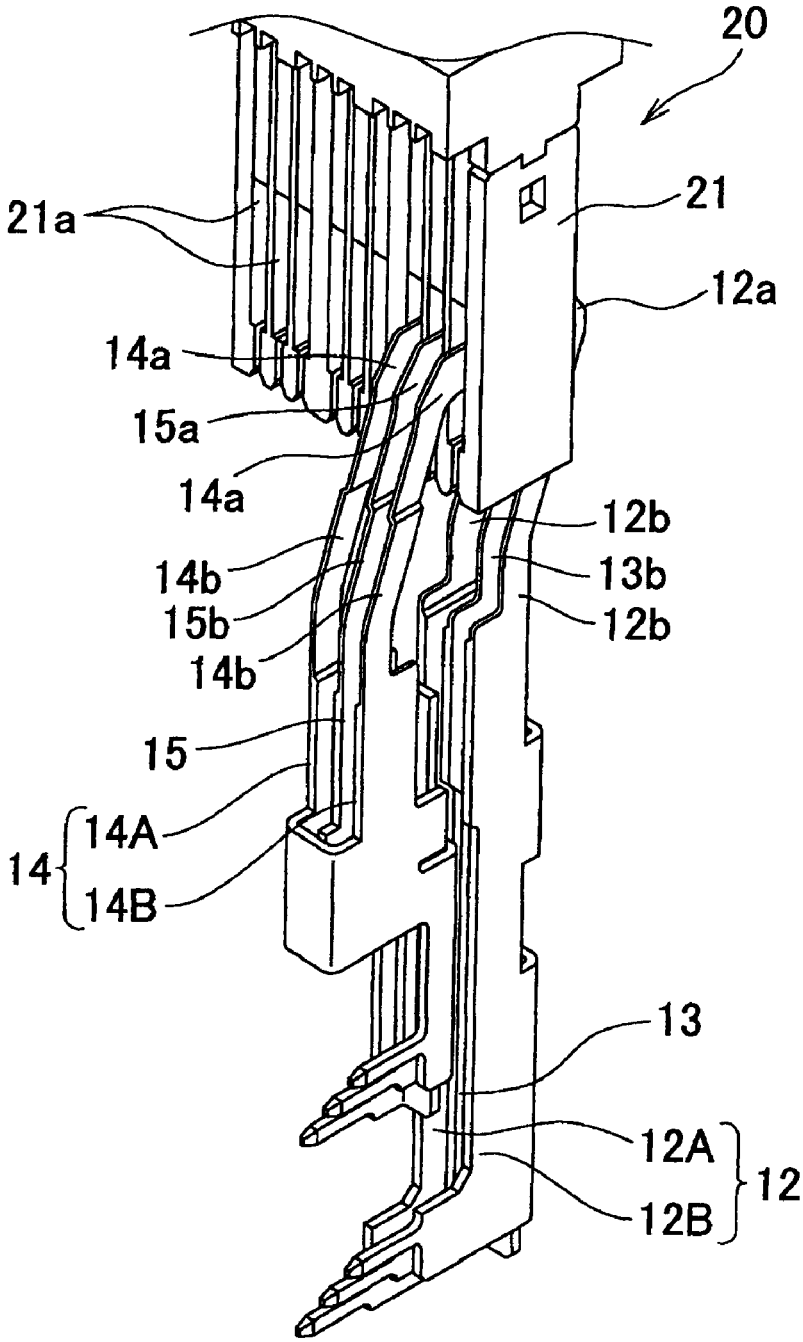
FIG. 20 is a perspective view showing a state in which the contacts appearing in FIG. 19 are elastically deformed.

As a result, the spring portions 12*b*, 13*b*, 14*b*, and 15*b* of the first combination contacts 12, the first signal contacts 13, the second combination contacts 14, and the second signal contacts 15 are bent (see FIG. 20), so that the contact portions 12*a*, 13*a*, 14*a*, and 15*a* are pressed to the contact portions of the contacts 22 of the cable connectors 20 by the spring forces of the spring portions 12*b*, 13*b*, 14*b*, and 15*b* trying to return to their original states, whereby the connector 10 and the cable connectors 20 are electrically connected.

According to the connector 10 of the present embodiment, the pressing force applied to the connecting portions 12*f* is positively transmitted to the terminal portions 12*d* via the linking portions 12*e*, and to the terminal portions 14*d* and the signal-side terminal portions 13*d* and 15*d* other than the terminal portions 12*d* via the alignment member 16. Therefore, it is possible to reliably insert the terminal portions 12*d* and 14*d* and the signal-side terminal portions 13*d* and 15*d* into the through holes of the printed board.

Figure 14:
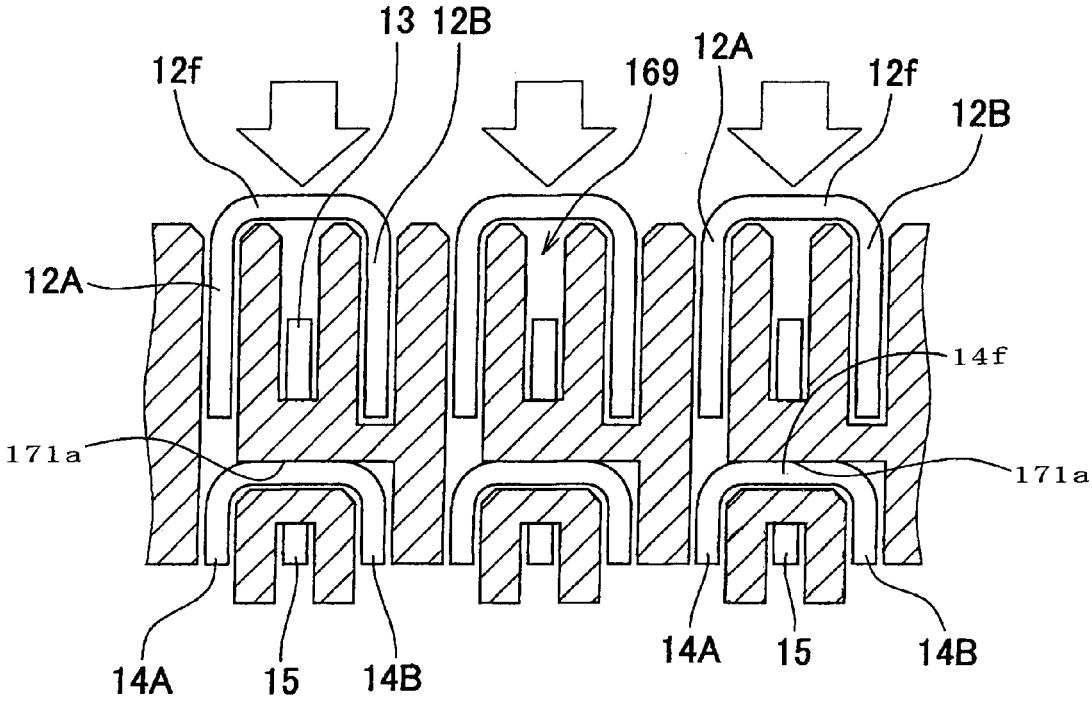
FIG. 14 is a schematic diagram showing a state in which combination contacts in an upper row of the connector shown in FIG. 1 are pressed.

Further, three sides of each first signal contact 13 are in a state surrounded by the first ground contact 12A, the second ground contact 12B, and the connecting portion 12*f* (see FIG. 14), and three sides of each second signal contact 15 are in a state surrounded by the third ground contact 14A, the fourth ground contact 14B, and the connecting portion 14*f*. Therefore, it is possible to improve shielding properties.

Since the contact portions 12*a*, 13*a*, 14*a*, and 15*a* of the first combination contacts 12, the first signal contacts 13, the second combination contacts 14, and the second signal contacts 15 are brought into direct contact with the contact portions of the contacts 22 of the cable connectors 20, a relay contact is no longer required.

The first combination contacts 12 and the first signal contacts 13, and the second combination contacts 14 and the second signal contacts 15 are arranged along the vertical direction D3 of the connector 10. Therefore, compared to a connector where the contacts in the upper row and the contacts in the lower row are staggered in the longitudinal direction D2 by half a pitch, it is possible to make the connector 10 compact in size.

It should be noted that although the cross-sectional shapes of the first combination contacts 12 and the second combination contacts 14 are substantially U-shaped at the connecting portions 12*f* and 14*f*, respectively, the cross-sectional shapes of the first combination contacts 12 and the second combination contacts 14 are not limited to the substantially U shape.

Further, although the terminal portions 12*d*, 13*d*, 14*d*, and 15*d* are terminal portions having the press-fit structure, the structure of the terminal portions may be of a pin type and a socket type but are not limited to the press-fit structure.

It is further understood by those skilled in the art that the foregoing are the preferred embodiments of the present invention, and that various changes and modification may be made thereto without departing from the spirit and scope thereof.

What is claimed is:

1. A connector comprising:

(i) a housing;

(ii) a plurality of ground contacts each including a holding portion that is held by said housing, a terminal portion to be inserted into a circuit board, and a linking portion that connects said holding portion and said terminal portion, wherein said terminal portion extends in a direction substantially orthogonal to said linking portion, wherein said plurality of ground contacts are arranged in a predetermined direction and disposed in two rows in a terminal portion-inserting direction that is perpendicular to the predetermined direction, wherein said plurality of ground contacts comprise a plurality of pairs of two ground contacts that are adjacent in the predetermined direction, wherein in each said pair, said linking portions of said adjacent ground contacts are connected by a connecting portion, so that each said pair of adjacent ground contacts constitutes a combination contact; and (iii) an alignment member that is mounted on said plurality of ground contacts, for positioning said terminal portions, wherein said alignment member includes receiving portions that receive said linking portions, open portions from which said connecting portions of said combination contacts in one row of the two rows are exposed to outside, and movement preventing portions that prevent relative movement of said connecting portions of said combination contacts in the other row of the two rows, in a direction toward the one row.

2. The connector as claimed in claim 1, further comprising a plurality of signal contacts each including a signal-side holding portion that is held by said housing, a signal-side terminal portion to be inserted into the circuit board, and a signal-side linking portion that connects said signal-side holding portion and said signal-side terminal portion, wherein said alignment member includes signal-side receiving portions that receive said signal-side linking portions, and wherein three sides of said signal-side linking portion of each of said signal contacts are surrounded by said linking portions of said pair of said ground contacts and said connecting portion that connects said linking portions, of a corresponding one of said combination contacts.

3. The connector as claimed in claim 1, wherein in each of said combination contacts, a cross-section of said linking portions of said pair of said ground contacts and said connecting portion that connects said linking portions has a substantially U shape.

4. The connector as claimed in claim 2, wherein in each of said combination contacts, a cross-section of said linking portions of said pair of said ground contacts and said connecting portion that connects said linking portions has a substantially U shape.

5. The connector as claimed in claim 2, wherein each of said terminal portion and said signal-side terminal portion has a press-fit structure to be pressed to inner peripheral surfaces of through holes of the circuit board.

6. The connector as claimed in claim 3, wherein each of said terminal portion and said signal-side terminal portion has a press-fit structure to be pressed to inner peripheral surfaces of through holes of the circuit board.

7. The connector as claimed in claim 4, wherein each of said terminal portion and said signal-side terminal portion has a press-fit structure to be pressed to inner peripheral surfaces of through holes of the circuit board.

* * * * *